US009074383B2

(12) United States Patent
McQueen et al.

(10) Patent No.: US 9,074,383 B2
(45) Date of Patent: Jul. 7, 2015

(54) FLOW CONTROL AND IMPROVED HEAT RISE CONTROL DEVICE FOR WATER HEATERS

(75) Inventors: E. Keith McQueen, Thousand Oaks, CA (US); Emily R. Colomes, Canoga Park, CA (US); Bruce William Maskell, Moorpark, CA (US)

(73) Assignee: ZODIAC POOL SYSTEMS, INC., Vista, CA (US)

( * ) Notice: Subject to any disclaimer, the term of this patent is extended or adjusted under 35 U.S.C. 154(b) by 742 days.

(21) Appl. No.: 13/211,456

(22) Filed: Aug. 17, 2011

(65) Prior Publication Data

US 2012/0042445 A1 Feb. 23, 2012

Related U.S. Application Data

(60) Provisional application No. 61/374,661, filed on Aug. 18, 2010.

(51) Int. Cl.

| | |
|---|---|
| ***E04H 4/00*** | (2006.01) |
| ***F24H 9/20*** | (2006.01) |
| ***E04H 4/12*** | (2006.01) |
| ***F24H 1/40*** | (2006.01) |
| ***F24H 9/00*** | (2006.01) |
| ***F24H 1/00*** | (2006.01) |

(52) U.S. Cl.

CPC ..... *E04H 4/129* (2013.01); *F24H 1/40* (2013.01); *F24H 9/0015* (2013.01); *F24H 9/2035* (2013.01); *F24H 1/0081* (2013.01)

(58) Field of Classification Search

USPC ..... 4/493; 137/599.14; 126/374.1

See application file for complete search history.

(56) References Cited

U.S. PATENT DOCUMENTS

| | | | | |
|---|---|---|---|---|
| 4,093,529 | A | 6/1978 | Strobach | |
| 4,515,307 | A * | 5/1985 | Ribaudo, Jr. | 236/25 R |
| 5,099,575 | A | 3/1992 | Colvin et al. | |
| 5,189,900 | A | 3/1993 | Colvin et al. | |
| 6,138,747 | A | 10/2000 | Kroger et al. | |
| 6,178,636 | B1 | 1/2001 | Kroger et al. | |
| 6,321,833 | B1 * | 11/2001 | O'Leary et al. | 165/151 |
| 7,086,249 | B2 | 8/2006 | Bae et al. | |
| 7,331,195 | B2 | 2/2008 | Bae et al. | |
| 7,527,069 | B2 * | 5/2009 | Denike et al. | 137/487.5 |
| 2008/0179051 | A1 * | 7/2008 | Willis et al. | 165/173 |

FOREIGN PATENT DOCUMENTS

WO 2009003244 A1 1/2009

* cited by examiner

*Primary Examiner* — Janie Christiansen

(74) *Attorney, Agent, or Firm* — Kilpatrick Townsend & Stockton LLP

(57) ABSTRACT

Disclosed are systems and devices for controlling the amount of water passing through a heat exchanger and the amount of water that by-passes the heater without passing through the heat exchanger. In some embodiments, the system includes a by-pass valve assembly having means for sensing a time-varying characteristic of fluid adjacent the inlet, means for sensing a time-varying characteristic of fluid adjacent the outlet, and a valve that alters the amount of fluid by-passing the fluid heater in response to differences in the time-varying characteristic of fluid adjacent the inlet and fluid adjacent the outlet.

12 Claims, 1 Drawing Sheet

FLOW CONTROL AND IMPROVED HEAT RISE CONTROL DEVICE FOR WATER HEATERS

RELATED APPLICATIONS

This application claims the benefit of U.S. Provisional Application Ser. No. 61/374,661 filed Aug. 18, 2010 titled "Improved Flow Control and Improved Heat Rise Control Device for Water Heaters," the content of which is hereby incorporated by reference.

FIELD OF THE INVENTION

This invention relates to water heaters, more specifically, but not exclusively to, gas-fired swimming pool heaters.

BACKGROUND

Experience with gas-fired swimming pool heaters over a period of several decades has resulted in designs that accommodate the unique technical challenges involved in heating pool water. In most heaters of current design, water is passed through finned tubing through which heat from gas combustion is transferred to it. It is necessary to control the water flow rate through the heat exchanger tubes for several reasons:

1. Pool water is cool relative to the dew point of gas combustion products, making it possible to condense water vapor from those products. Unless the heater is designed to accommodate such condensation, corrosion or fouling of the heat exchanger can result. In heaters not designed for such condensation, it has been avoided by limiting the velocity of water flowing through the tubes.

2. Pool water often has high levels of dissolved solids, not only because of what may naturally occur in the water supply, but also because as water evaporates from the surface of the pool, the dissolved solids are left behind, increasing the concentration. In water heating appliances, dissolved solids tend to precipitate on the hot surfaces of heat exchangers, a phenomenon typically referred to as "liming." The result of this precipitation is reduced heating efficiency and eventual failure of the heat exchanger. Liming can be avoided to a great extent by moving water over the heat exchanger surface at substantial velocity. In a pool heater this establishes a minimum velocity for water flow through the tubes. The required velocity depends on water temperature, however. If water is cool, lower velocities can be tolerated without liming, and conversely, higher velocities may be necessary if water is hot.

3. Flow of water in a tube can cause "erosion," a phenomenon in which metal is removed from the tube surface by combined mechanical and chemical action. Copper, which is commonly used in swimming pool heat exchangers, is especially vulnerable to erosion. The extent of erosion depends on the water chemistry and the velocity of water flow in the tube. In the design of a pool heater the effect is to limit the velocity of water flow.

4. If water velocity is too low, the water may not be able to absorb heat at the rate the heat is delivered by the heat exchanger surface. In that case, "steam flashing" (boiling) occurs at the surface and heat transfer becomes even worse, resulting in destruction of the exchanger.

5. Some pool heaters are designed for very high heating efficiency, and in those heaters, condensation of combustion product water is intended. Extraction of heat is maximized by cooling the products to temperatures below their dew point, thereby recapturing the heat of vaporization. Heat exchanger surfaces must be as cool as possible to accomplish condensation. Several factors affect the temperature of heat exchanger surfaces, but a major factor is water velocity. High velocity cools exchanger surfaces. (Heat exchangers in high efficiency heaters typically operate with condensation only in a specific section of the exchanger and have means for handling and disposal of condensed water in that section. Water flow requirements in the condensing and non-condensing sections differ.)

6. Modern swimming pool systems often include pumping and control equipment capable of circulating pool water at differing flow rates in order to accomplish filtration and heating with minimum use of electrical energy. A common approach is to operate the circulating pump at half of normal speed when possible. On a given system, pump power changes with the cube of pump speed, so resulting energy savings are substantial. In such systems, pool heaters must be capable of operating reliably and efficiently regardless of the system flow rate.

7. At any water flow rate, heating efficiency can be increased by reducing the gas energy input. Doing so effectively increases the amount of heat transfer surface per unit of energy input. In heaters capable of operating at reduced input, control design must be done in consideration of the water flow rate.

In view of these numerous and counter-acting factors, design of a pool heater heat exchanger is a complicated process. Choice of material, geometry and the paths for water and combustion product flow are substantial elements of that process. Control of the water flow rate is equally important, since velocities are directly proportional to the flow through the exchanger.

Typically swimming pool circulation systems operate at flow rates greatly larger than necessary for pool heater heat exchangers. Therefore, most heaters include means to by-pass much of the water flow around the heat exchanger, routing only the required flow through the exchanger. In addition to providing suitable flow through the exchanger, by-pass of water reduces pressure drop through the heater, and thereby reduces pumping power.

In the past, by-pass has been accomplished with simple mechanical or thermal devices. Existing devices such as spring-loaded by-pass valves have commonly been used to pass excess water flow from the heater inlet to the heater outlet without going through the heater tubes. This is most commonly done within the heater envelope, but this by-pass can also be contained in piping outside the heater. This by-passing of water is not only important to have some control of the water flowing through the heater tubes, but also to allow a large volume of water to pass without having substantial head losses through the heater at higher water flows. In the past, to adjust for varying installation conditions, the spring within the by-pass is adjusted or changed to adjust for the pool system flow.

In another type of water flow control, a thermostatic type valve similar to a water thermostatic valve in an automobile cooling system is used to control the amount of water allowed through the heat exchanger, and to by-pass the remainder of the by-passed water to the heater outlet. Typically, the thermostatic device is used in conjunction with a spring-loaded by-pass valve.

Both the spring-loaded by-pass valve method and the thermostatic valve method have limitations on the degree of control they provide, and are also limited by a minimum flow rate at which the heater will operate.

BRIEF SUMMARY

The terms "invention," "the invention," "this invention" and "the present invention" used in this patent are intended to refer broadly to all of the subject matter of this patent and the patent claims below. Statements containing these terms should be understood to not limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the appropriate portions of the entire specification of this patent, any or all drawings and each claim.

Embodiments provide a by-pass valve assembly for a fluid heater having an inlet and an outlet, comprising means for sensing a time-varying characteristic of fluid adjacent the inlet, means for sensing a time-varying characteristic of fluid adjacent the outlet, and a valve responsive to differences in the time-varying characteristic of fluid adjacent the inlet and fluid adjacent the outlet so as to alter an amount of fluid by-passing the fluid heater.

Also disclosed is a gas-fired swimming pool water heater comprising: a heat exchanger comprising a plurality of heater tubes or coils; a manifold in fluid communication with the heat exchanger and comprising a water inlet and a water outlet; and a valve assembly comprising means for sensing a time-varying characteristic of water adjacent the inlet, means for sensing a time-varying characteristic of water adjacent the outlet, and a valve responsive to differences in the time-varying characteristic of water adjacent the inlet and water adjacent the outlet so as to alter an amount of water by-passing the heat exchanger.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
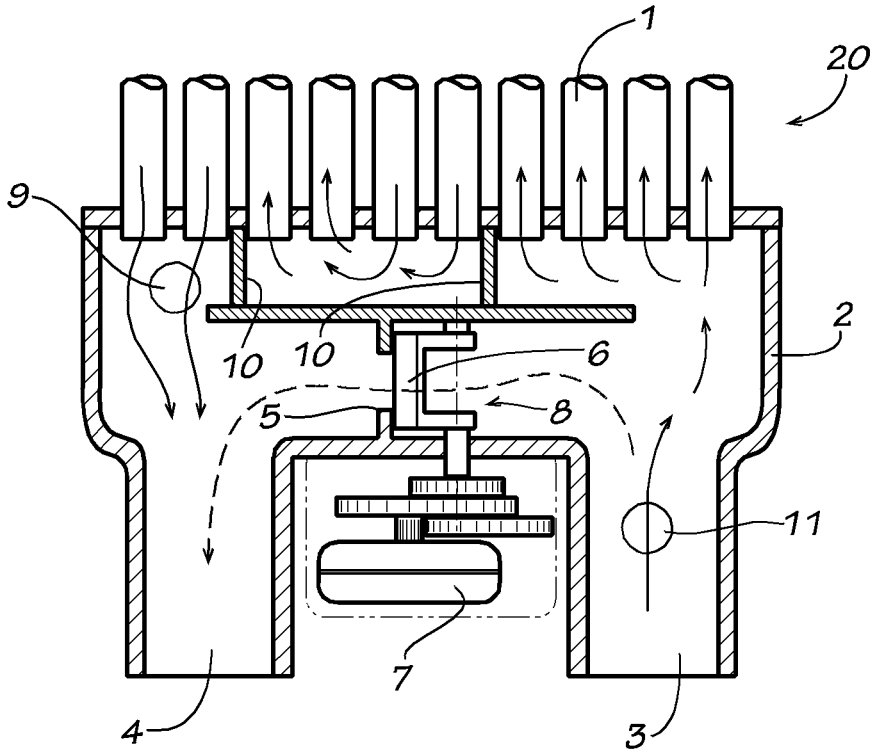
FIG. 1 illustrates water flow through a heater according to one embodiment.
Figure 2:
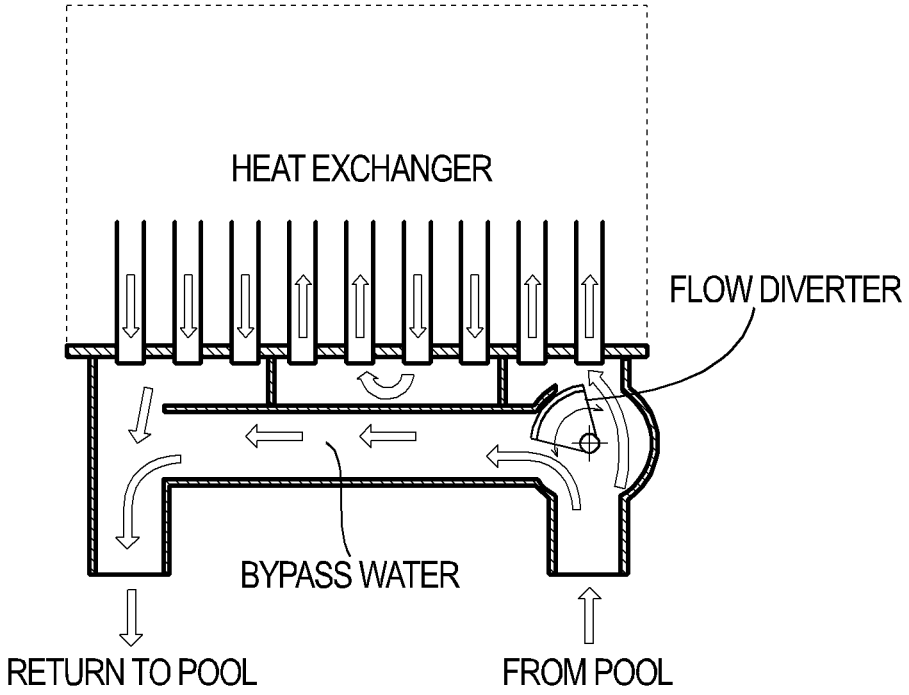
FIG. 2 is a schematic of water flow through a heater according to another embodiment.

Embodiments of the invention provide a means to control the flow of water to a heater and the resulting water temperature rise to allow a heater to operate under greatly varying flow and inlet water temperature conditions. Specifically, embodiments of the invention utilize a valve mechanism, such as a diverter or other suitable device, that controls the amount of water passing through the heater tubes or coils of the heat exchanger and the amount of water that by-passes the heater without passing through the heater tubes or coils of the heat exchanger. Controlling the amount of water passing through the heater tubes or coils may be accomplished by controlling the water flow through the by-pass area, by controlling the opening entering the heater tubes or coils, or a combination of both. FIG. 1 illustrates the control of water flow through the by-pass area alone by way of diverter 6. FIG. 2 illustrates a similar design that affords even more control, as the diverter is positioned closer to the inlet so the amount of opening into the entry of the heater tubes or coils can also be controlled by the diverter.

As shown in FIG. 1, a heater, such as heater 20, will typically have a manifold 2 that provides the connection means from the pool piping at a water inlet 3 to the heater 20 and a water outlet 4 from the heater 20, a by-pass water area 8 for water that does not pass through the heater tubes or coils 1, and a baffle or baffles 10 for directing the water flow and number of "passes" through the heater tubes or coils.

In the embodiment shown in FIG. 1, a valve diverter drive mechanism 7 rotates a diverter 6 about a port 5 to open and close the opening provided by port 5 to the by-pass water area 8 to vary the flow of water that is allowed through the heating tubes or coils 1 of the heat exchanger.

The arrows of FIG. 1 indicate a typical water flow through a heater 20 with multiple passes of the water in the tubes 1. The water flow is shown dashed through the water by-pass area 8.

As shown in FIG. 1, the heater 20 includes a water temperature sensor 11 at the water inlet 3 or adjacent thereto that provides the temperature of the incoming water. A water temperature sensor 9 at the water outlet or adjacent thereto from the heating tubes or coils 1 provides the temperature of the water coming out of the heater tubes or coils. An electronic circuit monitors these sensors and causes the water flow valve (including diverter 6 or other suitable mechanism) to open or close to the extent necessary to establish a heat exchanger flow rate that is correct for the inlet water temperature and the external system flow. Correct flow is sensed by feedback of the water temperature rise as indicated by the sensors. Flow not directed through the heat exchanger heater tubes or coils 1 is by-passed around it through by-pass area 8.

The position of the diverter is controlled through the constant monitoring of the inlet water temperatures before the water passes through the heater tubes or coils 1, and the water temperature of the heated water coming out of the heater tubes or coils 1. The differential in those water temperatures is used to control the position of the diverter and thus the amount of water flow permitted through the diverter. If higher heat rise is desired, the diverter allows less flow through the heater tubes or coils 1, and if lower heat rise is desired, the diverter allows higher flow through the heater tubes or coils 1.

In the illustrated embodiment, the operational flow range in which the heater can be used is also widened further in conjunction with using a reduced firing rate when water flow is low, which also reduces the amount of flame from the burners.

Although the diverter 6 is illustrated as housed within a heater manifold or the heater enclosure, the valve or other control mechanism also may be applied external to the heater components or the heater enclosure.

Water pressure differentials between the inlet and the outlet may be monitored as a function of time instead of or in addition to water temperature differentials and likewise used to control positioning of the valve. Other time-varying quantities (such as but not limited to shaft speed on an associated pump) likewise may be used as part of the valve-positioning control. Although an electronic controller is presently preferred, bi-metal springs or other mechanical controllers may be employed instead.

The disclosed systems may be used in conjunction with controlling the firing rate of the heater (the amount of flame/heat provided by the heater burners) to reduce the firing rate and increase efficiency when high input is not required.

The disclosed system for improved controls of water flow and temperature rise also allow for "maintenance" or "standby" heating of a pool or spa at temperatures lower than normal, thereby saving heat energy.

The system also eliminates the need for a heater installer to adjust the heater by-pass to work with the specific pool and equipment conditions in which it is installed. This is an adjustment that, if not conducted correctly, can cause operational problems for the heater and/or shorten its usable life.

Better control of the amount of water flowing through a heat exchanger, and thereby the water velocity and temperature rise, is desirable for improved efficiency, longer heater life and more consistent efficiency over the life of the heater. Other advantages such as simplified installation and reduced product failures are expected, as well as the ability to operate the heater in a much wider variation of system flow rates, which provides longer life for components while being able to operate at lower flows.

The embodiments described above are illustrative and non-limiting. Many variations of the structures illustrated in the drawings and the materials described are possible and within the scope of this invention.

The invention claimed is:

1. A by-pass valve assembly for a fluid heater having an inlet and an outlet, comprising:

a. means for sensing a time-varying characteristic of fluid adjacent the inlet;

b. means for sensing a time-varying characteristic of fluid adjacent the outlet; and c. a valve responsive to differences in the time-varying characteristic of fluid adjacent the inlet and fluid adjacent the outlet so as to alter an amount of fluid by-passing the fluid heater.

2. A by-pass valve assembly according to claim 1 in which the time-varying characteristic is temperature.

3. A by-pass valve assembly according to claim 2 in which the valve comprises a rotatable fluid diverter.

4. A gas-fired swimming pool water heater comprising:

a. a heat exchanger comprising a plurality of heater tubes or coils;

b. a manifold in fluid communication with the heat exchanger and comprising a water inlet and a water outlet; and c. a valve assembly comprising:

i. means for sensing a time-varying characteristic of water adjacent the inlet;

ii. means for sensing a time-varying characteristic of water adjacent the outlet; and iii. a valve responsive to differences in the time-varying characteristic of water adjacent the inlet and water adjacent the outlet so as to alter an amount of water by-passing the heat exchanger.

5. A gas-fired swimming pool water heater according to claim 4 further comprising means for altering an amount of heat transferred to water entering the heat exchanger.

6. A gas-fired swimming pool water heater according to claim 4 further comprising at least one baffle directing water flow into at least one tube or coil.

7. A gas-fired swimming pool water heater according to claim 4 in which the valve comprises a rotatable fluid diverter.

8. A gas-fired swimming pool water heater according to claim 4 in which the valve is positioned closer to the water inlet than to the water outlet.

9. A by-pass valve assembly for a fluid heater comprising:

a first sensor configured to sense a first time-varying characteristic of fluid adjacent an inlet;

a second sensor configured to sense a second time-varying characteristic of fluid adjacent an outlet;

a valve that alters an amount of fluid by-passing the fluid heater based on a differential between the first time-varying characteristic and the second time-varying characteristic.

10. The by-pass valve assembly of claim 9, wherein:

the first and second sensors are temperature sensors; and first time-varying characteristic is a first temperature and the second time-varying characteristic is a second temperature.

11. The by-pass valve assembly of claim 9, wherein the fluid heater is a swimming pool fluid heater.

12. The by-pass valve assembly of claim 9, further comprising a firing mechanism configured to alter an amount of heat generated by the fluid heater based on the amount of fluid by-passing the fluid heater.

* * * * *